United States Patent [19]

Kruger

[11] Patent Number: 4,794,895

[45] Date of Patent: Jan. 3, 1989

[54] SEALING ARRANGEMENT FOR A ROTARY SLIDE VALVE

[75] Inventor: Hermann Kruger, Wolfsburg, Fed. Rep. of Germany

[73] Assignee: Volkswagen AG, Wolfsburg, Fed. Rep. of Germany

[21] Appl. No.: 64,766

[22] Filed: Jun. 19, 1987

[30] Foreign Application Priority Data

Jun. 25, 1986 [DE] Fed. Rep. of Germany ..... 3621203

[51] Int. Cl.[4] ..... F01L 7/16

[52] U.S. Cl. ..... 123/190 E

[58] Field of Search ..... 123/190 E

[56] References Cited

U.S. PATENT DOCUMENTS 1,671,255 5/1978 Porter ..... 123/190 E
2,745,395 5/1956 Genet ..... 123/190 E
4,506,636 3/1985 Negre et al. ..... 123/190 E
4,606,309 8/1986 Fayard ..... 123/190 E

FOREIGN PATENT DOCUMENTS 0017901 of 1909 United Kingdom ..... 123/190 E

*Primary Examiner*—Willis R. Wolfe
*Assistant Examiner*—M. Macy
*Attorney, Agent, or Firm*—Brumbaugh, Graves, Donohue & Raymond

[57] ABSTRACT

For the purpose of attaining good sealing of a rotary slide valve under the action of gas forces in a pressure chamber adjacent to the valve, the sealing surface of a sliding ring bearing on the rotary slide valve, taking into account the gas-dynamic pressure forces, is dimensioned approximately double the size of the end face of the sliding ring facing the pressure chamber and acted on by the gas pressure.

13 Claims, 3 Drawing Sheets

SEALING ARRANGEMENT FOR A ROTARY SLIDE VALVE

BACKGROUND OF THE INVENTION

This invention relates to a sealing arrangement for a rotary slide valve which is subjected to fluctuating pressures in a pressure chamber adjacent to it, in particular to a combustion chamber of an internal combustion engine. The arrangement includes a sliding ring which, without benefit of oil lubrication, bears on the slide valve with at least one peripheral sliding surface under the effect of forces which are exerted by the pressure in the pressure chamber acting on it and by at least one spring. A housing accommodates the sliding ring. At least one sealing gasket, peripherally surrounding the sliding ring is axially held in a groove for sealing of a gap between the sliding ring and the housing.

A sealing arrangement of the above type, is known from U.S. Pat. No. 4,404,934 for the sealing of a rotary slide valve serving the control of the cylinder charge change of an internal combustion engine. It shall be understood that the rotary slide valve, within the meaning of the invention, may be a globe or flat rotary slide valve, in addition to a cylindrical rotary valve.

Contemplating the need for the application of the invention, we find that the sealing problem is worsened because the gas pressure exerted on and pressing the sliding ring against the rotary slide valve is subjected to very large fluctuations. In order for the pressure in the combustion chamber to cause a flawless contact pressure between the sliding ring and the rotary slide valve and thereby a good sealing of this site, the state of the art provides that the sliding surface be smaller than the sum of the surfaces facing the combustion chamber and the projections thereof which are subjected to the combustion chamber pressure in the direction of the rotary slide valve. At high combustion chamber pressures however, the gas pressure-generated contact pressure becomes very high and leads to high sliding surface wear.

SUMMARY OF THE INVENTION

It is an object of the invention to provide a sealing arrangement of the above-discussed type which retains the advantages of operation without oil lubrication in such a manner that in spite of flawless sealing, the wear on the collaborating sliding surfaces of the sliding ring and the rotary slide valve is negligible.

Pursuant to this object and others which will become apparent hereafter, one aspect of the present invention resides in a first embodiment of a sealing arrangement for a rotary slide valve wherein the sum of the pressure-stressed surfaces on the sliding ring facing away from the slide valve and their corresponding projection amounts to 0.4 to 0.7 times the sliding surface. The embodiment hereinafter being referred to as the dimensioning rule.

In a second embodiment, the groove for holding the sliding ring is provided on the housing side, and the sealing gasket is pretensioned radially inwardly. This second embodiment can also be used when there is oil lubrication and/or when the dimensioning rule of the first embodiment is not complied with. However, the measure according to the second embodiment aids in the solution of the problem in that if the sealing gaskets serving gas sealing are arranged in the housing-side grooves rather than in sliding ring-side grooves, the sliding ring may be relatively thin-walled over the height of the sealing gasket. Thus, altogether, a relatively small end face of the sliding ring exposed to gas pressure in the direction of the rotary slide valve can be attained. This, in turn, facilitates adherence to the rules of measurement as per the first embodiment with relatively small cross-sectional dimensions of the sliding ring in the region of its sliding surface.

The dimensioning rule is based on the following gas dynamics considerations:

If we assume between the sliding ring and the rotary slide valve an idealized leakage gap of minimal height, leaking gas will flow through the gap in accordance with the pressure head applied to it. In the simple case of a gap with constant height, length and width, leakage gas will flow through the gap at the speed of sound at supercritical pressure conditions. A pressure ranging from 0.49 to 0.56 times the gas pressure in the combustion chamber or, more generally speaking, in the pressure chamber will prevail in the gap, depending on the type of gas. With a view to complete equalization of the forces exerted by the gas pressure, the axially statically effective sliding ring pressure surface would have to be dimensioned in this case to 0.49 to 0.56 times the sliding surface of the sliding ring on the rotary slide valve.

In the case of pressure conditions which from a gas dynamics point of view are not critical, i.e., within the range of small combustion chamber pressures as well as at negative pressure heads, a negative contact pressure will occur which must be overcompensated by the force of the spring or an incomplete supercritical pressure equalization will occur. In any case, it follows from these considerations concerning gas dynamics that if the dimensioning rule is adhered to, a flawless sealing may be achieved and (inasmuch as the sliding surface of the sliding ring is rendered relatively large) undesirable wear of the collaborating sealing surfaces of sliding ring and rotary slide valve is avoided.

Obviously, it is possible to provide, in addition to the repeatedly mentioned sliding surfaces, other sliding surfaces which are gas pressure-relieved and further reduce wear.

Two examples of embodiments of the invention are explained in the following with reference to the figures which represent cross sections through the regions of the cylinder heads of internal combustion engines of interest here.

DETAILED DESCRIPTION OF THE PREFERRED EMBODIMENT

Figure 1:
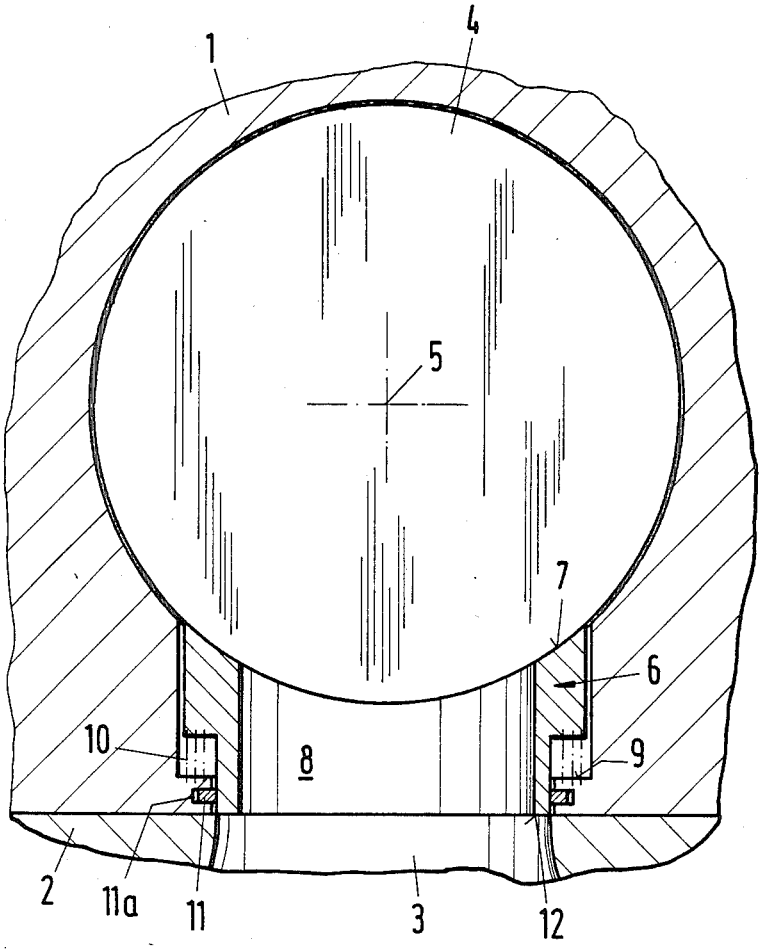
FIG. 1 is a cross-sectional view through the cylinder heads of an internal combustion engine.

Viewing initially FIG. 1, we find in the cylinder head -1- which is seated above the cylinder block -2- with the combustion chamber -3- of a combustion engine, a cylindrical rotary slide valve -4- constructed in a manner known in itself and therefore not illustrated. Its longitudinal axis is designated by -5-. The cylindrical rotary slide valve -4- contains ducts, whose construction is known and therefore not shown. The ducts extend essentially crosswise and/or lengthwise and which from time to time connect the combustion chamber -3- and further combustion chambers in the cylinder block -2- with a fresh gas supply means or with an exhaust system of the combustion engine.

The sealing arrangement, which in the context of the invention is of special interest, contains as an essential component, the sliding ring -6-. The sliding ring -6-, with its sliding surface -7-, slides on the peripheral surface of the rotary slide valve -4- when the slide valve performs rotating movements and encloses the duct -8-, and contains the pressure spring -10- bearing on the housing shoulder -9-. The pressure spring 10 exerts a force on the sliding ring -6- in the direction towards the rotary slide valve -4- as does the gas sealing gasket -11- which is inserted in the groove -11*a*- in the cylinder head -1-. Thus, the cylinder head -1- forms a housing for the rotary slide valve -4- as well as for the aforedescribed sealing arrangement.

The sliding ring -6- is constituted of a material which renders lubrication in the region of the sliding surface -7- unnecessary. The gas pressure acting on the combustion chamber-side end face -12- of the sliding ring -6- produces the essential portion of the contact pressure force between the sliding ring -6- and the rotary slide valve -4-, i.e., the essential portion of the sealing force. In order to render the sealing force in the region of the sliding surface -7- sufficiently large, on the one hand, but to avoid undesirable abrasion on the collaborating surfaces of sliding ring -6- and rotary slide valve -4-, on the other hand, the end face -12- of the sliding ring -6- subjected to the gas pressure amounts to 0.4 to 0.7 times the size of the sliding surface -7-, i.e., it is approximately half the size of the latter. Vice versa, it may be said that the sealing surface -7- is rendered approximately double the size of the end face -12-. To comply with this dimensioning rule, even in the case of a relatively thin-walled sliding ring -6-, the lodging of the gas sealing gasket -11- in a groove -11*a*- has a favorable effect in that the groove is not provided in accordance with the state of the art in the outer periphery of the sliding ring -6- but rather in the wall of the cylinder head -1- facing it.

Figure 2:
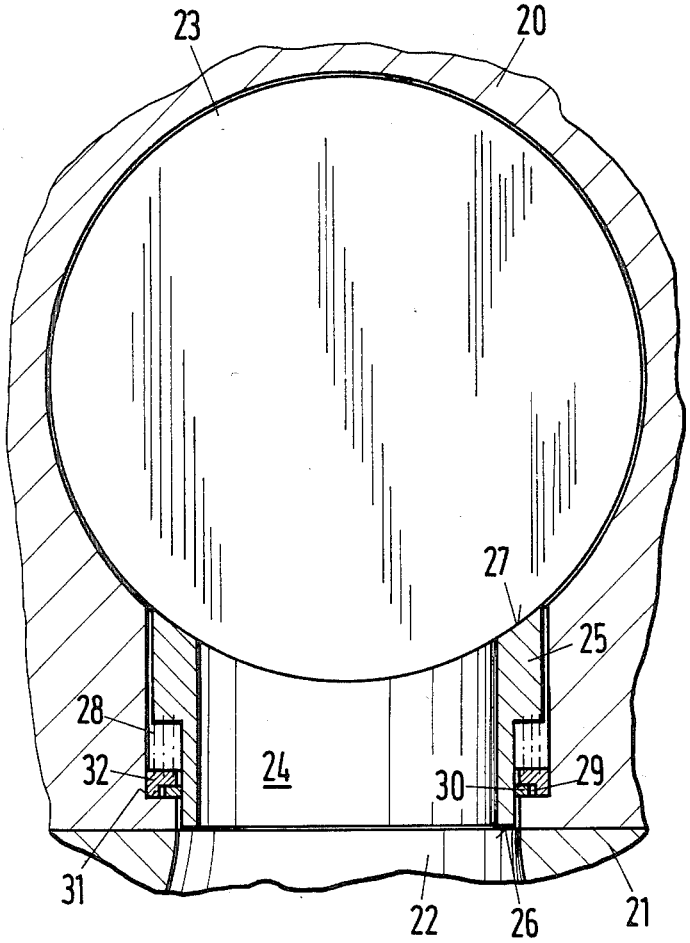
FIG. 2 is a cross-section view of another embodiment of the device in FIG. 1.

This characteristic also appears in a somewhat varied fashion in the example of the embodiment of FIG. 2. The cylinder head is designated here by -20-, the cylinder block by -21-, the combustion chamber by -22- and the duct connecting the latter with flow paths in the rotary slide valve -23- is designated by -24-. We again find a sliding ring -25- whose end face -26- acted on by gas pressure is approximately half the size of its sealing surface -27-, which under the action of the spring -28- and the gas pressure, is pressed against the peripheral surface of the rotary slide valve -23-.

In this example of an embodiment, the groove -29- accommodating the gas sealing gasket -30- is formed by the shoulder -31- in the cylinder head -20- and a clearance in the additional gasket -32- which is held down by the spring -28-.

Figure 3:
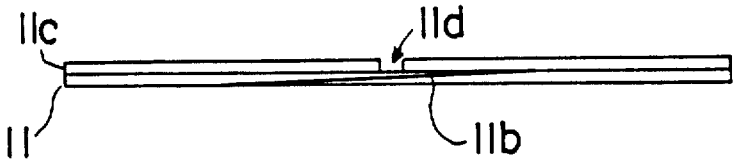
FIG. 3 is a side view showing a typical gas-sealing gasket arrangement for use in the invention.

In the construction as per FIG. 1, where the groove -11*a*- is directly sunk into the material of the cylinder head -1-, for the purpose of assembly, it is useful to employ a sealing gasket -11- having a slit -11*b*- as shown in FIG. 3 which can be compressed radially. In the compressed condition, the butt ends of the sealing gasket are superposed radially. Thus, it is advantageous to render the groove -11*a*- with a height which is double the height of the sealing gasket. As a matter of principle however, it is also possible to insert a sealing gasket having a plurality of windings. In such a case, the height of the groove will be chosen corresponding to the height of the sealing gasket during its diameter reduction. In order to ensure a firm seating of the sealing gasket in the groove, an additional gasket -11*c*-, shown in FIG. 3, may be subsequently inserted into the groove. Since the additional gasket does not serve any sealing purpose, it may have a relatively large assembly slit -11*d*-.

Thus, the invention creates, for a rotary slide valve, a sealing arrangement distinguished by good sealing efficiency and low wear and tear.

I claim:

1. A sealing arrangement for a rotary slide valve which is subjected to fluctuating pressures in a pressure chamber adjacent to it, in particular to the combustion chamber of an internal combustion engine, comprising:

a sliding ring, having an axis and at least one peripheral sliding surface under the effect of forces exerted on it by the pressure in the pressure chamber to which it is subjected, which bears in a sealing fashion on the slide valve;

a housing accommodating the sliding ring; and at least one sealing gasket which encloses the sliding ring on the periphery and is axially held in a groove, for sealing of a gap between the sliding ring and the housing, the groove being located within the housing and the sealing gasket being radially inwardly pretensioned in order to provide an effective seal with the sliding ring.

2. A sealing arrangement for a rotary slide valve which is subjected to fluctuating pressures in a pressure chamber adjacent to it, in particular to a combustion chamber of an internal combustion engine, comprising:

a sliding ring having an axis which, without benefit of oil lubrication, bears on the slide valve with at least one peripheral sliding surface under the effect of forces which are exerted by the pressure in the pressure chamber acting on it and by at least one spring;

a housing accommodating the sliding ring; and at least one sealing gasket, peripherally surrounding the sliding ring and being held in a groove which is coaxial with the sliding ring, for sealing of a gap between the sliding ring and the housing wherein the sum of the effective pressure surfaces of the sliding ring facing away from the slide valve amounts to approximately 0.4 to 0.7 times the sliding surface of the sliding ring on the slide valve, wherein said sliding surface of the sliding ring bears in a sealing fashion on the slide valve at least partially under the effect of the forces exerted by the pressure in the pressure chamber, the groove being located within the housing and the sealing gasket being radially inwardly pretensioned in order to provide an effective seal with the sliding ring.

3. A sealing arrangement as in claim 2, wherein the sealing gasket has ends, and is slit so that the ends are overlapping in the axial direction, producing an increase in the axial height of the gasket as the diameter of the gasket is reduced, and the groove has a height in the axial direction dimensioned approximately equal to the height of the sealing gasket at the reduced diameter of the gasket.

4. A sealing arrangement as in claim 3, and further comprising at least one additional ring having spaced ends arranged in the groove axially next to the sealing gasket.

5. A sealing arrangement as in claim 2, wherein the groove is directly in the housing.

6. A sealing arrangement as in claim 5, wherein the sealing gasket has ends, and is slit so that the ends are overlapping in the axial direction, producing an increase in the axial height of the gasket as the diameter of the gasket is reduced, and the groove has a height in the axial direction dimensioned approximately equal to the height of the sealing gasket at reduced diameter of the gasket.

7. A sealing arrangement as in claim 6, and further comprising at least one additional ring having speced ends arranged in the groove axially next to the sealing gasket.

8. A sealing arrangement as in claim 2, wherein the groove is formed by an inner shoulder of the housing which faces the slide valve, and an additional ring.

9. A sealing arrangement as in claim 8, wherein the sealing gasket has ends, and is slit so that the ends are overlapping in the axial direction, producing an increase in the axial height of the gasket as the diameter of the gasket is reduced, and the groove has a height in the axial direction dimensioned approximately equal to the height of the sealing gasket at reduced diameter of the gasket.

10. A sealing arrangement as in claim 9, and further comprising at least one additional ring having spaced ends arranged in the groove axially next to the sealing gasket.

11. A sealing arrangement as in claim 8, wherein the additional ring is held down by a spring clamped between said additional ring and an outer shoulder on the sliding ring so as to press the sliding ring against the slide valve.

12. A sealing arrangement as in claim 11, wherein the sealing gasket has ends, and is slit so that the ends are overlapping in the axial direction, producing an increase in the axial height of the gasket as the diameter of the gasket is reduced, and the groove has a height in the axial direction dimensioned approximately equal to the height of the sealing gasket at reduced diameter of the gasket.

13. A sealing arrangement as in claim 12, and further comprising at least one additional ring having spaced ends arranged in the groove axially next to the sealing gasket.

* * * * *

UNITED STATES PATENT AND TRADEMARK OFFICE

CERTIFICATE OF CORRECTION

PATENT NO. : 4,794,895

DATED : January 3, 1989

INVENTOR(S) : Hermann Kruger

It is certified that error appears in the above-identified patent and that said Letters Patent is hereby corrected as shown below:

Figure 3 should be added as per attached sheet.

Col. 1, line 55, "projection" should read --projections--.

Signed and Sealed this

Twenty-second Day of August, 1989

*Attest:*

DONALD J. QUIGG

*Attesting Officer*

*Commissioner of Patents and Trademarks*